US008616107B2

(12) United States Patent
Kraft et al.

(10) Patent No.: US 8,616,107 B2
(45) Date of Patent: Dec. 31, 2013

(54) PUNCHING TOOL

(75) Inventors: Stefan Kraft, Schnabelwaid (DE); Andreas Deuerlein, Egloffstein (DE)

(73) Assignee: Pass Stanztechnik AG, Creussen (DE)

( * ) Notice: Subject to any disclaimer, the term of this patent is extended or adjusted under 35 U.S.C. 154(b) by 126 days.

(21) Appl. No.: 13/260,326

(22) PCT Filed: Mar. 11, 2010

(86) PCT No.: PCT/EP2010/001511

§ 371 (c)(1), (2), (4) Date: Sep. 25, 2011

(87) PCT Pub. No.: WO2010/112126

PCT Pub. Date: Oct. 7, 2010

(65) Prior Publication Data

US 2012/0067189 A1 Mar. 22, 2012

(30) Foreign Application Priority Data

Apr. 3, 2009 (DE) ..... 10 2009 016 136

(51) Int. Cl.
*B21D 28/34* (2006.01)

(52) U.S. Cl.
USPC ..... 83/686; 83/698.71; 83/698.91

(58) Field of Classification Search
USPC ..... 83/686, 684, 685, 698.91, 699.31, 83/698.51, 698.61, 699.41
See application file for complete search history.

(56) References Cited

U.S. PATENT DOCUMENTS

| | | | | |
|---|---|---|---|---|
| 5,081,891 | A * | 1/1992 | Johnson et al. | 83/140 |
| 5,127,293 | A | 7/1992 | Chatham | |
| 5,839,341 | A | 11/1998 | Johnson et al. | |
| 7,658,134 | B2 * | 2/2010 | Morgan | 83/530 |
| 7,698,979 | B2 * | 4/2010 | Sugizaki et al. | 83/140 |
| 7,954,404 | B2 * | 6/2011 | Thielges et al. | 83/140 |
| 7,958,807 | B2 * | 6/2011 | Endo | 83/140 |
| 8,327,745 | B2 * | 12/2012 | Lee et al. | 83/686 |

FOREIGN PATENT DOCUMENTS

| | | | |
|---|---|---|---|
| DE | 29609541 | U1 | 11/1996 |
| DE | 102006005572 | A1 | 6/2007 |
| JP | 2002/282963 | A1 | 10/2002 |
| JP | 2006000915 | A1 | 1/2006 |

* cited by examiner

*Primary Examiner* — Omar Flores Sanchez
(74) *Attorney, Agent, or Firm* — Browdy and Neimark, PLLC

(57) ABSTRACT

A punching tool has a safety device prevents a punching die from being undesirably released from a guide housing when the punching tool is gripped at the head. The safety device has a base guide body securely mounted relative to the punching die at least with respect to a gripping force direction acting on the punching die and a counter guide body securely mounted relative to the housing at least with respect to the gripping force direction. The guide bodies are designed to ensure a secure interaction in at least one retaining relative circumferential position while allowing release of the punching die from the guide housing in the gripping force direction in a release relative circumferential position displaced relative to the retaining relative circumferential position in the circumferential direction about the longitudinal axis. As a result, an unwanted release of the punching die from the guide housing is securely prevented.

6 Claims, 5 Drawing Sheets

PUNCHING TOOL

This application claims the priority of International Patent Application No. PCT/EP2010/001 511, filed on Mar. 11, 2010, and of German Patent Application No. DE 10 2009 016 136.8, filed on Apr. 3, 2009, pursuant to 35 U.S.C. 119(a)-(d), the content of which is incorporated herein by reference in its entirety as if fully set forth herein.

BACKGROUND OF THE INVENTION

1. Field of the Invention

The invention relates to a punching tool comprising a punching die and a guide housing in which the punching die is guided.

2. Background Art

A punching tool of this type is known from DE 296 09 541 US, from U.S. Pat. No. 5,127,293 and through prior public use. A punching tool of this type may be employed in a punch press, in particular in a turret punch press, together with an automated tool changer. A plurality of such punching tools may then be disposed in a storage shelf which is connected with a punch press, which uses in each case one of the punching tools, via an automated tool changer. The tool is removed from the storage shelf or from a turret of the punch press by means of the automated tool changer which grips the punching tool at its head. When this happens, it is of vital importance to prevent the guide housing from being undesirably released from the punching die when the punching tool is gripped at its head.

SUMMARY OF THE INVENTION

It is therefore an aspect of the present invention to develop a punching tool of the type named at the outset in such a way that such an undesirable release is securely prevented.

This aspect is achieved according to the invention by a punching tool comprising a punching die for forming at least one punched hole in a work-piece; a guide housing in which the punching die is guided along a punching displacement movement thereof; with the punching die comprising a punching member with a punching portion; a head; a safety device which secures the punching die against an unwanted release from the guide housing when the punching tool is gripped at the head and which comprises a base guide body which is securely mounted relative to the punching die at least with respect to a gripping force direction acting on the punching die in a direction opposite to a punching direction; a counter guide body which is securely mounted relative to the housing at least with respect to the gripping force direction and is displaceable relative to the base guide body in the circumferential direction about a longitudinal axis of the punching tool, with the guide bodies being designed in such a way that in at least one retaining relative circumferential position, they interact in a securing manner and in a release relative circumferential position, which is displaced relative to said retaining relative circumferential position in the circumferential direction about the longitudinal axis, they allow the punching die to be released from the guide housing in the gripping force direction, with the base guide body being designed as at least one circumferential rib which extends about the longitudinal axis of the punching tool over a portion of a circumference, with the counter guide body being designed as at least one guide groove which is complementary to the at least one circumferential rib and extends about the longitudinal axis of the punching tool at least over a portion of the circumference, and with the circumferential rib being provided in an annular lid which encloses the punching die and which rests on a circumferential collar of the guide housing.

It has been found according to the invention that a retaining device which ensures that the punching die is releasably secured to the guide housing in a gripping force direction is not sufficient to ensure safe operation of a punch press together with an automated tool changer. The safety device according to the invention ensures easy mounting of the punching tool in such a way that safety screws for securing the guide housing to the punching die are not required. The safety device according to the invention in particular allows length adjustments to be performed by rotating the guide housing relative to the head of the punching die without loosening a safety screw. During operation, the guide bodies are in a retaining relative circumferential position which allows the automated tool changer to securely grip the head of the punching die without letting go of the guide housing. In the retaining relative circumferential position, the guide bodies are positively connected to one another in a way as to support each other. The head may be a component which is separate from the punching member but releasably connected to the punching member. Alternatively, it is conceivable as well to design the punching die in such a way that the punching member is formed in one piece with the head. Designing the safety device in such a way that the base guide body is in the form of at least one circumferential rib which extends around the longitudinal axis of the punching tool over a portion of a circumference thereof, with the counter guide body being in the form of at least one guide groove which is complementary to the at least one circumferential rib and extends around the longitudinal axis of the punching tool over at least a portion of the circumference thereof, provides for a low-cost production of the safety device. On the other hand, it is of course conceivable as well to design the base guide body as a guide groove and the counter guide body as a circumferential rib.

Arranging a circumferential rib in an annular lid which encloses the punching die and rests on a circumferential collar of the guide housing proved to be suitable for practical application. The annular lid may at the same time form a counter bearing for a punch compression spring which moves the punching die back to its initial position after punching. Moving the guide body from the retaining relative circumferential position to the release relative circumferential position securely prevents the guide housing from being undesirably released and allows the guide housing to be easily released for demounting, for example, and for maintenance purposes in particular. As soon as the guide body is in the release relative circumferential position, it is no longer necessary to additionally actuate a release device prior to releasing the guide housing. According to the invention, it is not the punching die which forms the counter body for securing the guide housing but the annular lid which encloses the punching die. The punching die itself may then be a standard component which need not be provided with a guide body for the safety device. Thanks to the inventive design with the circumferential rib being provided in the annular lid in the form of one of the guide bodies, it is no longer necessary to provide an additional safety component when designing the safety device, as is the case for the punching tool according to DE 296 09 541 U1 which needs to be provided with an additional retaining ring.

A design of the punching tool in such a way that it comprises exactly two circumferential ribs and exactly two guide grooves, there being provided two recesses between the two guide grooves when seen in the circumferential direction, with each of the two recesses having a circumferential extension which is at least equal to the circumferential extension of one of the circumferential ribs, allows easy mounting and demounting of the punching tool. When the recesses coincide with the circumferential ribs when seen in the circumferential direction, then the release relative circumferential position is reached.

Arranging the guide groove in the form of a circumferential groove in an inner circumferential housing wall of the guide housing proved to be suitable for practical application.

A locking device for releasably locking the guide bodies in the retaining relative circumferential position ensures that the punching tool is exclusively operated in the at least one retaining relative circumferential position.

An additional retaining device for additionally and releasably securing the punching die against an unwanted release from the guide housing when the punching tool is gripped at the head in the release relative circumferential position of the guide bodies prevents the guide housing from being undesirably released from the punching die even in the release relative circumferential position. This is advantageous when performing a length adjustment of the punching die which may be carried out by rotating the punching member relative to the head when a correspondingly designed screw thread is provided.

A circumferential marking at the guide housing and/or at the punching die which indicates the circumferential relative position in particular makes it easier to find the release relative circumferential position for mounting or demounting the punching tool.

An embodiment of the invention will hereinafter be explained in more detail by means of the drawing.

DESCRIPTION OF THE PREFERRED EMBODIMENT

Figure 1:
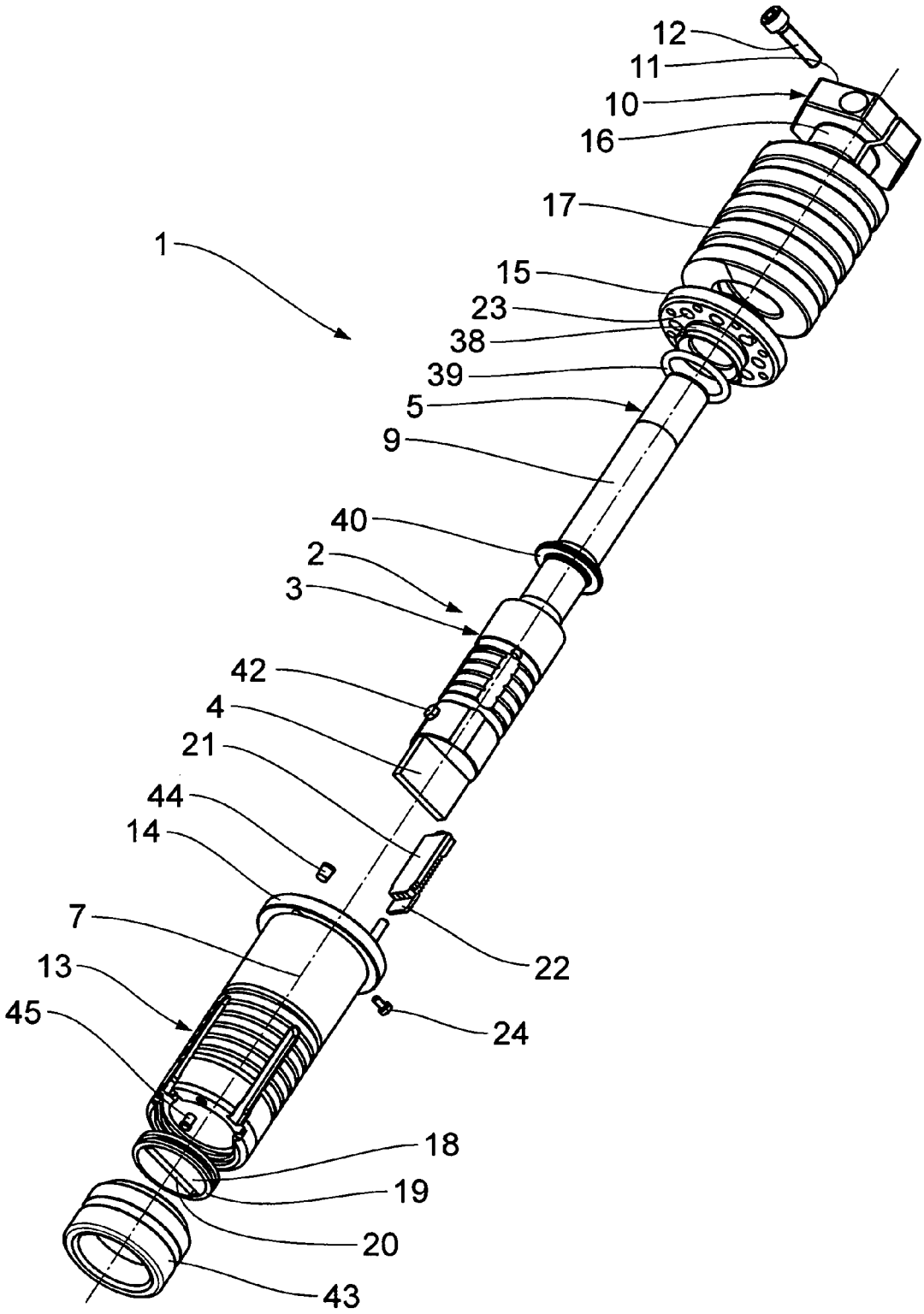
FIG. 1 shows an exploded view of a punching tool comprising a punching die and a guide housing.

A punching tool 1 has a punching die 2 for forming at least one punched holed in a workpiece. The punching die 2 has a punching member 3 comprising the actual punching portion 4 which comes into contact with the workpiece and a head 5 which is secured to the punching member 3 by means of a screw connection which is not shown in more detail.

Perpendicular to a longitudinal axis 7 of the punching tool 1, the punching portion 4 has a cross-section which corresponds to the cross-section of the punched hole to be produced. This cross-section is rectangular in the illustrated embodiment. Depending on the desired outer shape of the punched hole, the punching portion 4 may of course also have another cross-sectional shape, for example a round, square or oval cross-section, or even a particular shape such as a star-shaped cross-section. An inner circumferential wall of the punching member 3 has an internal thread (not visible in the drawing) of the screw connection for connecting the punching member 3 with the head 5.

The head 5 comprises a die driver 9 which faces the punching member 3 and a die head element 10 comprising a head surface 11 which is acted upon by the punch press in which the punching tool 1 is located. The die head element 10 and the die driver 9 are clamped and therefore secured to each other by means of a cylindrical screw 12 (cf. FIG. 1). An outer circumferential wall of the die driver 9 has an external thread of the screw connection by means of which the punching member 3 is connected to the head 5.

A length of the punching die 2 between the head surface 11 and the punching portion 4 is adjustable by adjusting a screw-in depth of the screw connection between the punching member 3 and the head 5.

The punching die 2 is guided in a guide housing 13 of the punching tool 1 along a punch displacing movement which is parallel to the longitudinal axis 7. An annular lid 15 rests on a near-head circumferential collar 14 of the guide housing 13. Between this annular lid 15 and a circumferential collar 16 of the die head element 10, a punch compression spring 17 is provided which is a helical spring or a disk spring assembly. The punch compression spring 17 serves to bias the punching tool 1 in a rest position. In this rest position, the punching portion 4 is retracted by some tenths of a millimeter behind a stripper body's 19 end stripper surface 18 which is arranged at a front side.

When the punching die 2 is mounted, the annular lid 15 is non-positively connected to the die driver 9 in a non-rotational manner.

The stripper body 19 is fixed and secured to the guide housing 13. The stripper body 19 has a stripper opening 20 which is complementary to the cross-section of the punching portion 4 and through which the punching portion 4 is guided during punching.

The punching tool 1 is equipped with a release slide 21 which has the function of a locking body for longitudinal adjustment of the punching tool 1 by rotating the punching member 3 relative to the head 5 about the screw connection provided in-between. In a locking position of the release slide 21, a portion of the release slide 21 which is opposite to a release bias spring 22 engages with one of a plurality of locking receptacles 23 which in the form of are axial through-bores in the annular lid 15 of the punching tool 1. The locking receptacles 23 of the punching tool 1 are evenly distributed around the longitudinal axis 7 when seen in the circumferential direction.

A cylindrical screw 24 which has been screwed into the near-lid circumferential collar 14 of the guide housing 13 radially from the outside secures the release slide 21 in the locking position in which the release slide 21 is biased by means of the release bias spring 22 which is in the form of a compression spring. The cylindrical screw 24 engages with a groove provided in the release slide 21 of the punching tool 1 in a direction which is axial, in other words parallel, to the longitudinal axis 7.

Figure 2:
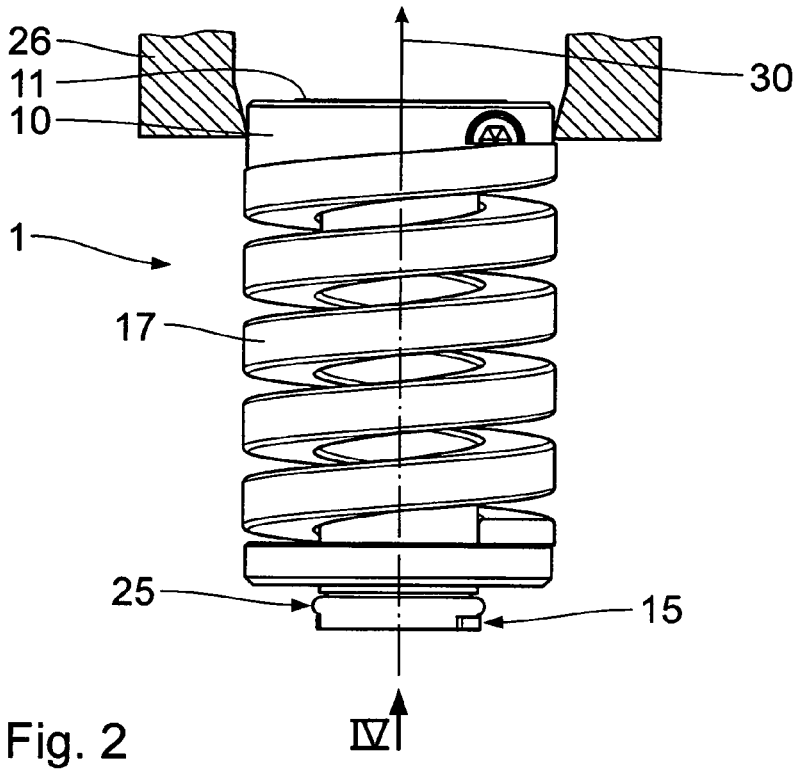
FIG. 2 shows a partial assembly of a component group near the head of the punching tool according to FIG. 1, a gripping tool gripping said punching tool being indicated in a schematic cross-sectional view.

A safety device 25 prevents the punching die 2 from being undesirably released from the guide housing 13 when the punching tool 1 is gripped at the head 5 or at the die head element 10. Said gripping movement is indicated in FIG. 2 by a schematically indicated automated tool changer gripper 26.

Figure 6:
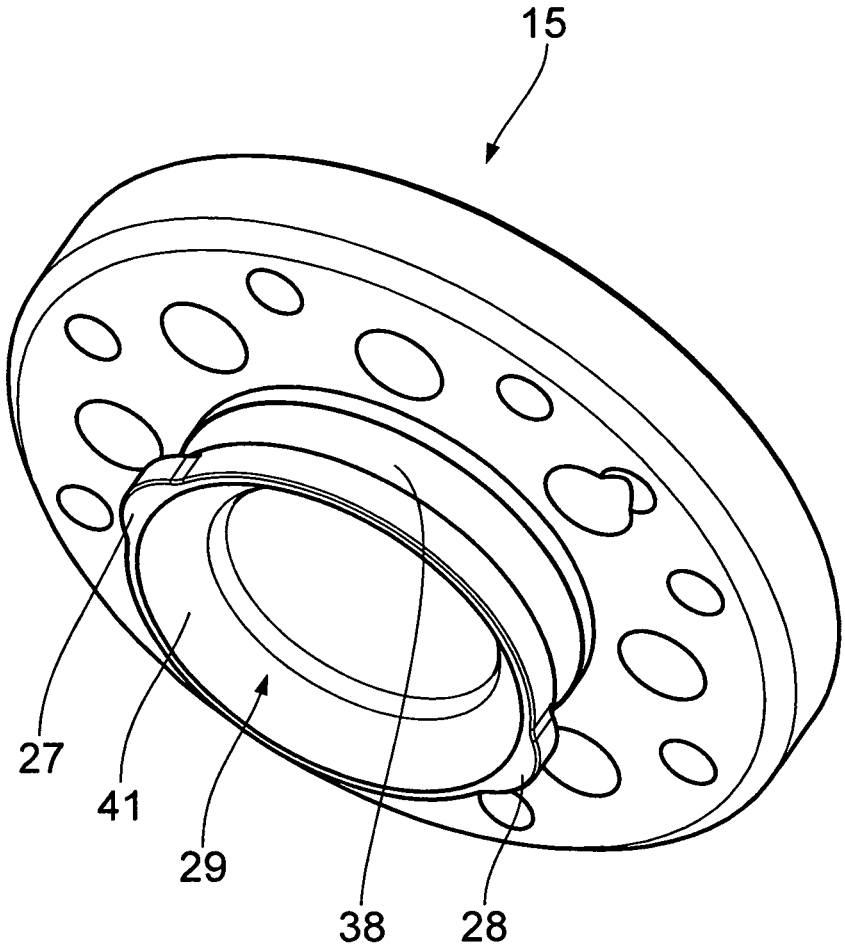
FIG. 6 shows a perspective view of an annular lid, which encloses the punching die when the punching tool is mounted, together with a base guide body of a safety device in the form of two circumferential ribs which in each case extend around the annular lid over a portion of the circumference.
Figure 7:
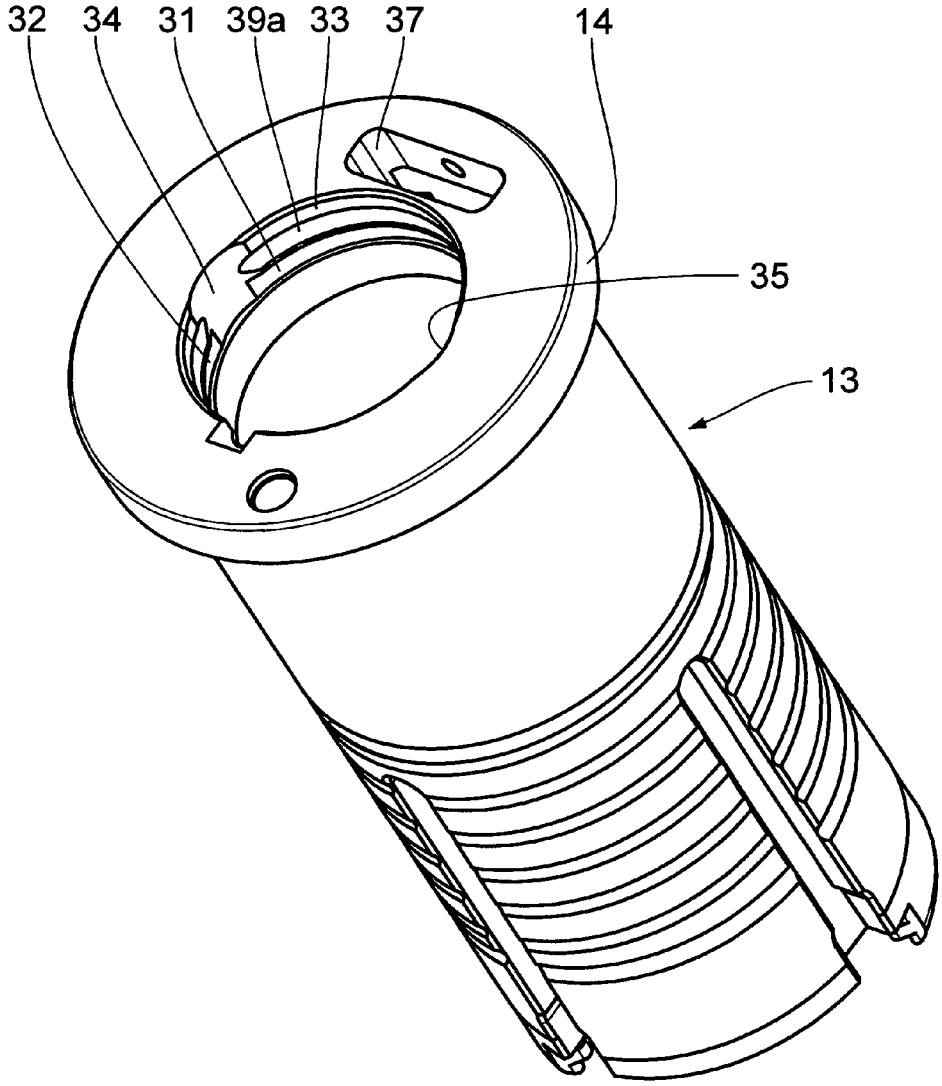
FIG. 7 shows another perspective view of a portion of the guide housing near the annular lid together with a counter guide body of the safety device which is in the form of two guide grooves which are complementary to the base guide body and extend in each case over a portion of the circumference of the guide housing.

The safety device 25 has a base guide body in the form of two circumferential ribs 27, 28. The circumferential ribs 27, 28 are formed in one piece with a sleeve projection 29 of the annular lid 15 (cf. also FIGS. 4 and 6). As they are formed in one piece with the annular lid 15, the circumferential ribs 27, 28 are rigidly secured to the punching die 2 relative to a gripping force direction 30 (cf. FIG. 3) which is opposite to a punching direction as the annular lid 15 is a component which is rigidly secured to the punching die 2 once the punching tool 1 has been mounted.

The circumferential ribs 27, 28 extend in each case about the longitudinal axis 7 of the punching tool 1 over a portion of a circumference. Between these circumferential portions, a larger circumferential region of the sleeve projection 29 is not provided with ribs. In the illustrated embodiment, exactly two circumferential ribs 27, 28 are provided.

The safety device 25 furthermore has a counter guide body in the form of two guide grooves 31, 32. The counter guide body is an integral component of the guide housing 13 and is therefore mounted securely or stationarily to the housing relative to the gripping force direction 30. By rotating the guide housing 13 about the longitudinal axis 7 relative to the annular lid 15, the circumferential ribs 27, 28 of the base guide body are displaceable in the circumferential direction about the longitudinal axis 7 of the punching tool 1 relative to the guide grooves 31, 32 of the counter guide body of the safety device 25.

As far as groove width, the shape of the groove bottom, rib width, radial rib extension and rib cross-section are concerned, the two guide grooves 31, 32 are complementary to the circumferential ribs 27, 28. The guide grooves 31, 32 extend about the longitudinal axis 7 of the punching tool 1 across in each case a portion of the circumference of the guide housing 13. The guide grooves 31, 32 are circumferential grooves in an inner housing wall 33 in the region of the circumferential collar 14 of the guide housing 13.

Between the two guide grooves 31, 32, there are two recesses 34, 35 in the inner circumferential housing wall 33 when seen in the circumferential direction about the longitudinal axis 7 so that an internal diameter of the circumferential housing wall 33 in the region of the recesses exceeds the radius of the circumferential ribs 27, 28. Moreover, the two recesses 34, 35 have a circumferential extension about the longitudinal axis 7 which slightly exceeds the circumferential extension of the circumferential ribs 27, 28.

If the circumferential position of the circumferential ribs 27, 28 corresponds to the circumferential position of the recesses 34, 35, the complementary design of the circumferential ribs 27, 28 relative to the guide grooves 31, 32 on the one hand and to the recesses 34, 35 on the other allows the sleeve projection 29 to be inserted into the guide housing 13 from the circumferential collar 14 until the circumferential ribs 27, 28 are on the same axial position as the guide grooves 31, 32. This circumferential position in which it is possible to insert the sleeve projection 29 of the annular lid 15 into the guide housing 13 is also referred to as release relative circumferential position of the safety device 25.

If the circumferential ribs 27, 28 are on the same axial position as the guide grooves 31, 32, the annular lid 15 is rotatable about the longitudinal axis 7 relative to the guide housing 13 from the release relative circumferential position into a retaining relative circumferential position in which the circumferential ribs 27, 28 engage with the guide grooves 31, 32 so as to ensure a secure, positively connected interaction of these two guide bodies of the safety device 25. In this position, the positive connection between the circumferential ribs 27, 28 and the guide grooves 31, 32 prevents the guide housing 13 from being undesirably released from the annular lid 15 when acted upon in the gripping force direction 30.

The release slide 21 has a locking projection 36 which passes through an axially extending through-opening 37 in the circumferential collar 14 of the guide housing 13.

Axially between the annular body of the annular lid 15 in which the locking recesses 23 are provided and the circumferential ribs 27, 28, the sleeve projection 29 of the annular lid 15 is provided with a circumferential groove 38 in which an O-ring 39 is inserted (cf. FIG. 1).

When the sleeve projection 29 has been inserted into the guide housing 13, the O-ring 39 comes to rest in another circumferential groove **39*a* in the inner circumferential housing wall 33, thus ensuring that the punching die 2 is additionally and releasably secured against an unwanted release from the guide housing 13 even in the release relative circumferential position of the annular lid 15 relative to the guide housing 13 when the punching tool 1 is gripped at its head 5**.

Together with the circumferential grooves 38, **39*a* in the annular lid 15 on the one hand and in the circumferential housing wall 33 on the other, the O-ring 39 forms an additional fixing device for the punching die 2 at the guide housing 13**.

The guide housing 13 and/or the punching die 2 or the annular lid 15 may be provided with a circumferential marking (not shown in the drawing) which indicates the current relative circumferential position of the annular lid 15 relative to the guide housing 13.

When the punching die 2 is assembled, the die driver 9 is inserted into the annular lid 15, into the punching compression spring 17 and into the die head element 10. By means of the cylindrical screw 12, the die driver 9 is secured to the die head element 10 in an axial position in which a circumferential cone 40 of the die driver 9 is in secure contact with a complementary circumferential cone 41 of the annular lid 15. Thus secured, the annular lid 15 is rigidly connected to the other components of the punching die 2.

Figure 3:
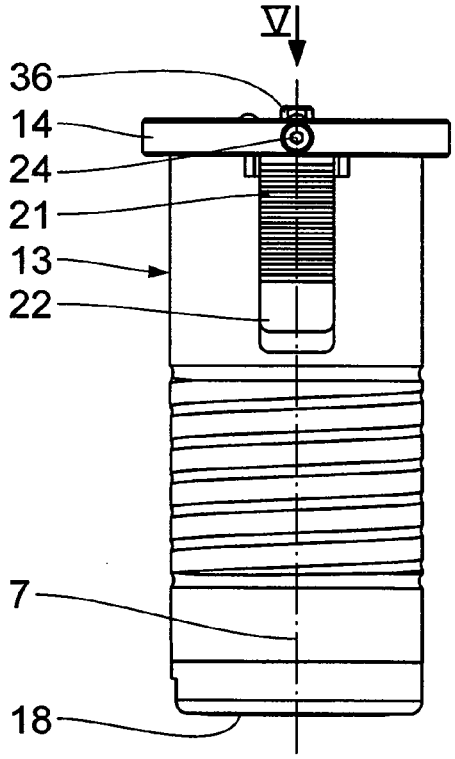
FIG. 3 shows a partial assembly of the guide housing of the punching tool according to FIG. 1.
Figure 4:
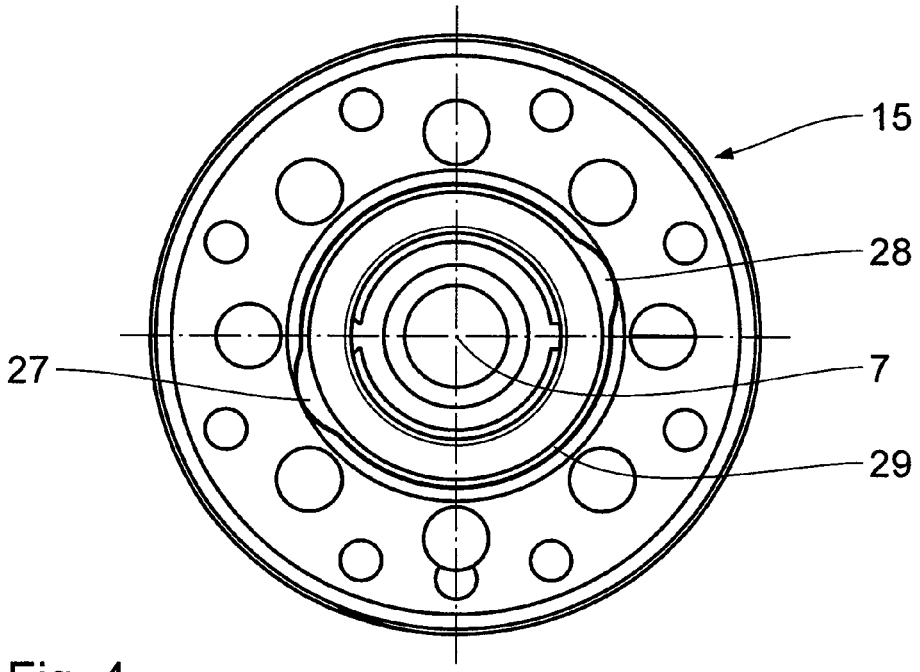
FIG. 4 shows an enlarged view according to FIG. 2 from direction IV in FIG. 2.
Figure 5:
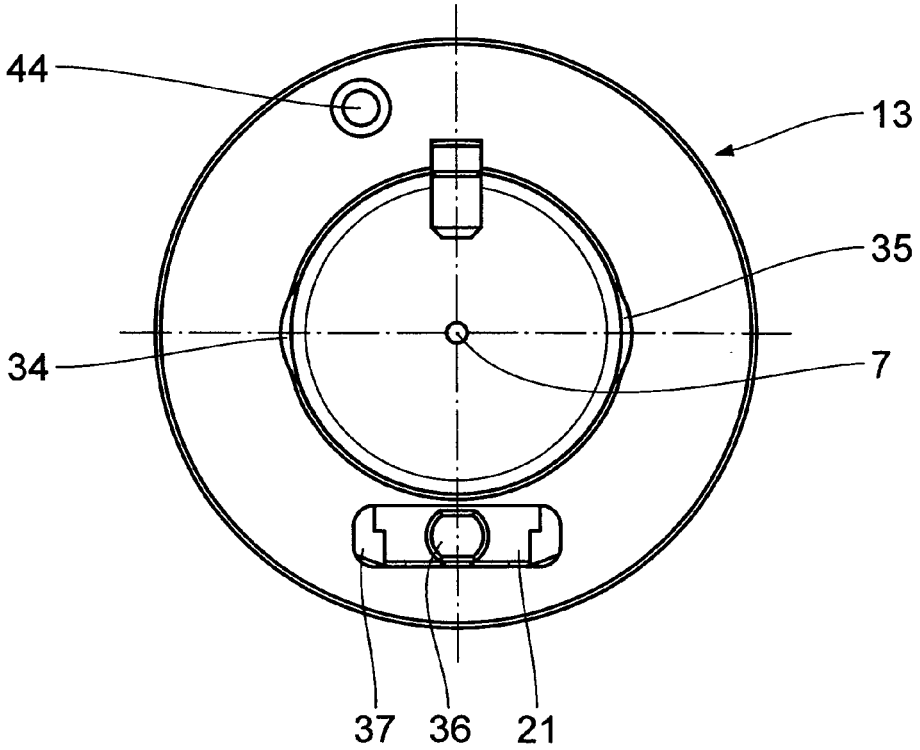
FIG. 5 shows an enlarged view according to FIG. 3 from direction V in FIG. 3.

The unit thus completed may then be connected to the guide housing 13 which has been pre-mounted according to FIG. 3. To this end, the annular lid 15 and the guide housing 13 are rotated in the circumferential direction about the longitudinal axis 7 in such a way as to be oriented in the release relative circumferential position, and the circumferential ribs 27, 28 are inserted into the recesses 34, 35 until they come to rest on the same axial position as the guide grooves 31, 32. In order to find the correct relative circumferential position, the guide housing is provided with a circumferential marking which is in line with a corresponding circumferential marking of the annular lid 15 when the release relative circumferential position is reached. Afterwards, the guide housing 13 may be rotated about the longitudinal axis 7 relative to the annular lid 15 until the retaining relative circumferential position is reached. The illustrated embodiment is provided with a total of eight retaining relative circumferential positions in which the locking projection 36 of the release slide 21 is in line with one of the eight locking recesses 23 in the annular lid 15. In these retaining relative circumferential positions, the release slide 21 serves as a locking device for releasably securing the guide bodies 27, 28 and 31, 32 in the retaining relative circumferential position.

In order to adjust the length of the punching die 2, the punching member 3 may be rotated about the longitudinal axis relative to the head 5. This is done by rotating the guide housing 13 about the longitudinal axis 7 relative to the annular lid 15. To this end, the release slide 21 is operated so as to move the locking projection 36 out of the respective locking receptacle 23 in such a way as to unlock the device. When the punching member 3 is rotated to adjust the length of the punching die 2, the release relative circumferential position of the guide housing 13 relative to the annular lid 15 is temporarily reached as well. In this release relative circumferential position, the fixing device comprising the O-ring 39 prevents the guide housing 13 from being undesirably released from the punching die 2.

Once the length adjustment has been performed and the release slide 21 is no longer operated, the guide housing 13 is rotated about the longitudinal axis 7 relative to the annular lid 15 until the locking projection 36 of the release slide 21 latches into the next locking receptacle 23 when seen in the circumferential direction; when this happens, the release bias spring 22 is biased. Due to the selection of circumferential positions of the circumferential ribs 27, 28 relative to the selection of circumferential positions of the recesses 34, 35, the punching tool 1 is always in the safety relative release position when in the latch position. Once the punching tool 1 has been adjusted in length and is thus ready for automated tool changing, the safety device 25 ensures that when the die head element 10 is gripped by the automated tool changer gripper 26, the guide housing 13 is securely prevented from being undesirably released from the punching die 2.

The punching tool 1 is provided with an anti-rotation protection in the form of a guide pin 42 preventing a rotating movement of the punching member 3 relative to the guide housing 13, the guide pin 42 being inserted in the punching member 3 so as to engage with an axially extending longitudinal groove in the guide housing 13.

The illustration of the punching tool 1 also shows a lower tool part 43 which is arranged below the guide housing. When the punching tool 1 is operated, the workpiece is positioned between the end stripper surface 18 and the lower tool part 43.

A spring-loaded ball pressure piece 44 in a front wall of the guide housing 13 facing the annular lid 15 (cf. exploded view according to FIG. 1) provides for a clicking/latching sound when the punching tool 1 is adjusted in length. Another spring-loaded ball pressure piece 45 serving as a transport safety device is provided on the opposite front side of the guide housing 13.

The invention claimed is:

1. A punching tool (1) comprising a punching die (2) for forming at least one punched hole in a workpiece;

a guide housing (13) in which the punching die (2) is guided along a punching displacement movement thereof;

with the punching die (2) comprising a punching member (3) with a punching portion (4); a head (5);

a safety device (25) which secures the punching die (2) against an unwanted release from the guide housing (13) when the punching tool (1) is gripped at the head (5) and which comprises a base guide body (27, 28) which is securely mounted relative to the punching die (2) at least with respect to a gripping force direction (30) acting on the punching die (2) in a direction opposite to a punching direction;

a counter guide body (31, 32) which is securely mounted relative to the housing at least with respect to the gripping force direction (30) and is displaceable relative to the base guide body (27, 28) in the circumferential direction about a longitudinal axis (7) of the punching tool (1), with the guide bodies (27, 28; 31, 32) being designed in such a way so that in at least one retaining relative circumferential position, the guide bodies (27, 28; 31, 32) interact in a securing manner;

in a release relative circumferential position, which is displaced relative to said retaining relative circumferential position in the circumferential direction about the longitudinal axis (7), the guide bodies (27, 28; 31, 32) allow the punching die (2) to be released from the guide housing (13) in the gripping force direction (30), with the base guide body (27, 28) being designed as at least one circumferential rib which extends about the longitudinal axis (7) of the punching tool (1) over a portion of a circumference, with the counter guide body (31, 32) being designed as at least one guide groove which is complementary to the at least one circumferential rib and extends about the longitudinal axis (7) of the punching tool (1) at least over a portion of the circumference, wherein the punching tool comprises exactly two circumferential ribs (27, 28) and exactly two guide grooves (31, 32), there being provided two recesses (34, 35) between the two guide grooves (31, 32) when seen in the circumferential direction, with each of the two recesses (34, 35) having a circumferential extension which is at least equal to the circumferential extension of one of the circumferential ribs (27, 28);

with the circumferential rib (27, 28) being provided in an annular lid (15) which encloses the punching die (2) and which rests on a circumferential collar (14) of the guide housing (13).

2. A punching tool according to claim 1, wherein the guide groove (31, 32) is a circumferential groove in an inner circumferential housing wall (33) of the guide housing (13).

3. A punching tool according to claim 1, further comprising a locking device (21) for releasably locking the guide bodies (27, 28; 31, 32) in the retaining relative circumferential position.

4. A punching tool according to claim 1, further comprising an additional fixing device (39) for additionally and releasably securing the punching die (2) against an unwanted release from the guide housing (13) when the punching tool (1) is gripped at the head (5) in the release relative circumferential position of the guide bodies (27, 28; 31, 32).

5. A punching tool according to claim 1, further comprising a circumferential marking at at least one of the guide housing (13) and at the punching die (2) which indicates the circumferential relative position.

6. A punching tool (1) comprising a punching die (2) for forming at least one punched hole in a workpiece;

a guide housing (13) in which the punching die (2) is guided along a punching displacement movement thereof;

with the punching die (2) comprising a punching member (3) with a punching portion (4); a head (5);

a safety device (25) which secures the punching die (2) against an unwanted release from the guide housing (13) when the punching tool (1) is gripped at the head (5) and which comprises a base guide body (27, 28) which is securely mounted relative to the punching die (2) at least with respect to a gripping force direction (30) acting on the punching die (2) in a direction opposite to a punching direction;

a counter guide body (31, 32) which is securely mounted relative to the housing at least with respect to the gripping force direction (30) and is displaceable relative to the base guide body (27, 28) in the circumferential direction about a longitudinal axis (7) of the punching tool (1), with the guide bodies (27, 28; 31, 32) being designed so that in at least one retaining relative circumferential position, the guide bodies (27, 28; 31, 32) interact in a securing manner;

in a release relative circumferential position, which is displaced relative to said retaining relative circumferential position in the circumferential direction about the longitudinal axis (7), the guide bodies (27, 28; 31, 32) allow the punching die (2) to be released from the guide housing (13) in the gripping force direction (30), with the base guide body (27, 28) being designed as at least one circumferential rib which extends about the longitudinal axis (7) of the punching tool (1) over a portion of a circumference, with the counter guide body (31, 32) being designed as at least one guide groove which is complementary to the at least one circumferential rib and extends about the longitudinal axis (7) of the punching tool (1) at least over a portion of the circumference;

with the circumferential rib (27, 28) being provided in an annular lid (15) which encloses the punching die (2) and which rests on a circumferential collar (14) of the guide housing (13), and the punching tool further comprising a circumferential marking at at least one of the guide housing (13) and at the punching die (2) which indicates the circumferential relative position.

* * * * *